US005433669A

United States Patent [19]

Chang et al.

[11] Patent Number: 5,433,669

[45] Date of Patent: Jul. 18, 1995

[54] TOY FLYING DEVICE

[75] Inventors: Richard S. Chang, Rolling Hills Estates; Ian Ayton, Santa Ynez, both of Calif.

[73] Assignee: Lewis Galoob Toys, Inc., South San Francisco, Calif.

[21] Appl. No.: 194,243

[22] Filed: Feb. 10, 1994

[51] Int. Cl.[6] ..... A63H 27/04

[52] U.S. Cl. ..... 472/11; 472/6; 446/31; 446/36

[58] Field of Search ..... 472/1, 6–10; 476/11; 446/30–33, 36

[56] References Cited

U.S. PATENT DOCUMENTS

| | | | |
|---|---|---|---|
| 2,779,595 | 1/1957 | Ensley | 272/31 |
| 2,885,206 | 5/1959 | Ensley | 272/31 |
| 2,901,251 | 8/1959 | Pettit | 272/31 |
| 2,907,569 | 10/1959 | Taylor | 272/31 |
| 2,913,243 | 11/1959 | Cottle | 272/31 |
| 2,942,880 | 6/1960 | Bennett | 272/31 |
| 3,022,069 | 2/1962 | Pettit | 272/31 |
| 3,136,543 | 6/1964 | Merl et al. | 272/31 |
| 3,446,502 | 5/1969 | Damron et al. | 272/31 |
| 3,512,773 | 5/1970 | Jacobs | 272/31 |
| 3,556,520 | 1/1971 | Hunt | 272/31 |
| 3,731,424 | 5/1973 | Meyer | 472/11 X |
| 3,740,032 | 6/1973 | Chang | 272/31 |
| 3,743,279 | 7/1973 | Chang | 272/31 |
| 3,858,872 | 1/1975 | Summerfield et al. | 272/31 |
| 4,095,784 | 6/1978 | Kennedy et al. | 272/31 |
| 4,153,243 | 5/1979 | Batchelor | 272/31 |
| 4,222,558 | 9/1980 | Tinguely et al. | 472/11 |
| 4,981,456 | 1/1991 | Sato et al. | 446/30 X |
| 5,304,090 | 4/1994 | Vanni | 446/36 |
| 5,334,070 | 8/1994 | Yu et al. | 446/31 |

FOREIGN PATENT DOCUMENTS

| | | | |
|---|---|---|---|
| 972155 | 8/1975 | Canada | 46/31 |
| 975174 | 9/1975 | Canada | 46/31 |
| 2008960 | 6/1979 | United Kingdom | 27/4 |

*Primary Examiner*—Carl D. Friedman
*Assistant Examiner*—Beth A. Aubrey
*Attorney, Agent, or Firm*—Dergosits & Noah

[57] ABSTRACT

A remotely controlled toy flying system in which the pitch of the toy flying device is controlled by the same drive shaft and drive shaft tube that is used to transmit power to the rotor of the toy flying device. A child can easily control the pitch of the toy flying device by rotating a knob. Rotation of the knob displaces the drive shaft, lifts the pitch link member and rotates the pitch shaft and toy flying device. Tilting the toy flying device causes the rotor to have a horizontal component of thrust causing the toy flying device to rotate in a fixed arc around the pivot member in the direction in which the knob is rotated by the child. Speed of the toy flying device rotor is controlled by the fore and aft motion of a lever.

24 Claims, 6 Drawing Sheets

TOY FLYING DEVICE

TECHNICAL FIELD OF THE INVENTION

The present invention relates to a remotely operated toy flying device system, and more particularly to a novel system for remotely controlling the speed and pitch of the toy flying device flying around a fixed pylon or tower.

BACKGROUND OF THE INVENTION

Remote control mechanisms for controlling the flight of toy flying devices are well-known in the prior art. Most of the prior an toy flying devices involve complex mechanical linkages or counterweights to manipulate the speed and direction of the toy flying device around a fixed radius. Typically, these devices utilized levers, multiple cables and bell cranks to cause the device to fly level, climb or descend during circumferential flight. These additional moving pans contributed to the potential unreliability and increased expense of manufacturing the toy. Moreover, these additional moving pans increased the control friction which caused less sensitivity and less control of the toy. Further, none of the prior an toy flying devices used a rotatable knob to control the pitch of the toy during flight. This is advantageous because it is less confusing to children since rotation of the knob in the clockwise direction will cause the toy flying device to move in clockwise direction around the pivot member and vice-versa for rotation in the counterclockwise direction.

SUMMARY OF THE INVENTION

It is therefore an object of the present invention to provide a mechanically simplistic remote toy flying system which can be manufactured at relatively low cost.

It is another object to provide a toy flying system wherein the pitch of the toy flying device is controlled using the same cable and sheath as that used to transmit the power to the toy flying device rotor.

It is yet another object of the present invention to reduce control friction to a minimum which allows greater sensitivity and improved ease of control.

It is still another object of the invention to provide a more intuitive way of controlling the pitch of the toy flying device so that it is less confusing to children.

It is yet still another object of the present invention to provide a remote toy flying device which can be used in connection with different themed playsets.

In accordance with one embodiment of the present invention, these and further objects are achieved in a toy flying system which includes a flying device having a rotor remotely controlled by two control input members. The speed of the flying device rotor is controlled by a power control member which varies the voltage applied to the motor. The pitch of the toy flying device is controlled by a rotatable pitch control member. The pitch control member engages the motor frame which holds the motor in the motor housing. Rotation of the pitch control member causes the motor frame securing the motor to be displaced axially within the motor housing. This axial displacement causes the drive shaft attached to the motor to be displaced within the drive shaft robe. The drive shaft tube is connected to the motor housing at one end and secured within the yoke at the other end. The yoke is rotatably received in the pivot member. A drive shaft collar is attached to the drive shaft. The collar moves coincidentally with the drive shaft within the yoke.

Between the two wings of the yoke is a pitch link member. The bottom cavity end of the pitch link member rotatably supports the drive shaft collar attached to the drive shaft. Upward movement of the drive shaft collar translates to upward movement of the pitch link member between the wings of the yoke. The yoke is rotatably secured to the pitch link member housing such that the pitch link member housing can freely rotate in a vertical plane about the wings of the yoke. The top end of the pitch link member has an aperture which is connected to an arm extending radially from a pitch shaft. The pitch shaft extends outward from the pitch link member housing is attached to the toy flying device housing. A pitch shaft control member is clamped between the two arms of the link member housing and extends outward to the toy flying device. The pitch shaft control member has two channels running through it to allow the pitch shaft and drive shaft to rotate within the pitch shaft control member. The pitch link member transfers the upward motion of the drive shaft collar member to the radial arm of the pitch shaft causing the pitch shaft to rotate within the pitch shaft control member. Since the toy flying device housing is connected to the pitch shaft at the other end, any rotation of the pitch shaft causes a corresponding change in the pitch attitude of the toy flying device.

In another embodiment of the present invention, the drive shaft tube is connected to the motor frame at one end and the pitch link member at the other end. The motor is secured within the motor housing so that it does not move longitudinally. Rotation of the pitch control member causes the motor frame to be displaced which causes the drive shaft tube to be displaced. Since the drive shaft tube is connected to the pitch link member, displacement of the drive shaft tube causes upward movement of the pitch link member between the wings of the yoke which in turn causes rotation of the pitch shaft.

These and further objects of the invention will become apparent to those of ordinary skill in the art by reference to the figures and detailed description which follow.

DETAILED DESCRIPTION OF THE INVENTION

The present invention will now be described with reference to preferred embodiments in which the toy flying device is a helicopter. While the preferred embodiment is described below with reference to a helicopter, it is contemplated that other toy flying devices such as airplanes and spaceships may be substituted for the helicopter and still be within the scope of the present invention. The present invention is also described below with reference to embodiments in which the components of the toy flying system are contained in a one piece base molding. However, it is intended that the base component of the present invention can include multiple sections. It is also intended that the base molding can comprise different playset themes consisting of different terrain, buildings and roads. Such playsets may include military and construction themes.

As used throughout the present specification, the term pitch refers to the orientation of the rotor. Pitch is not used to describe the angular position of the individual rotor blades. While the preferred embodiment employs a rotor having fixed blades, it is intended to be within the scope of the present invention to use a rotor with adjustable blades.

Figure 1:
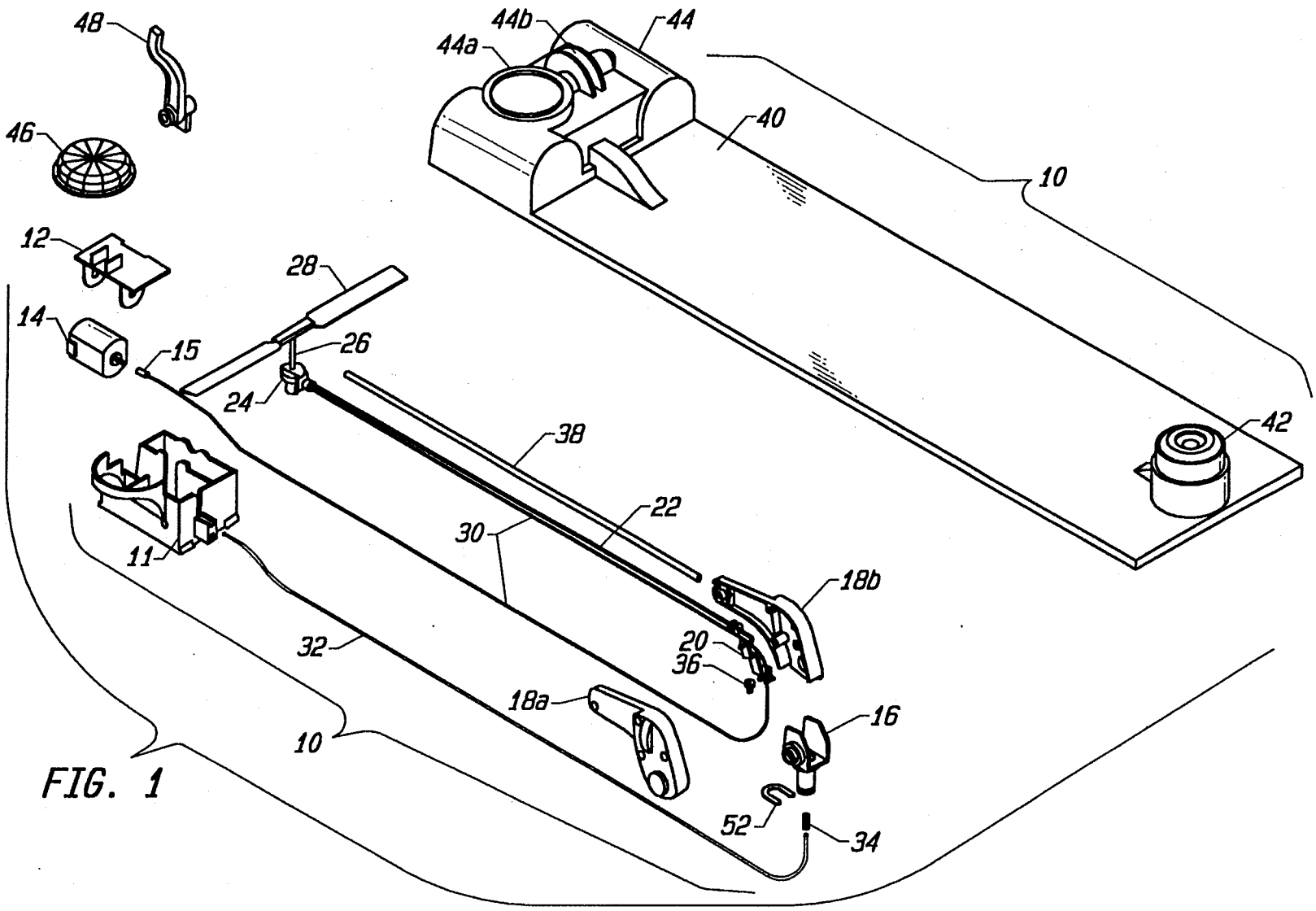
FIG. 1 is an exploded view of the toy flying system shown in accordance with one embodiment of the invention.

A toy flying system 10 in accordance with one embodiment of the present invention is shown in FIG. 1. The present invention enables the control of the rotor speed and rotor pitch using two dimensions of drive shaft movement: rotational movement for speed and longitudinal movement for pitch. The toy flying system 10 includes a motor frame housing 11 which is designed to slidably receive a motor frame 12 and motor 14. Between the motor frame housing 11 and the toy flying device, a yoke 16 is rotatably secured within pitch link member housing arms 18. A pitch link member 20 is located between the wings 16*a* and 16*b* of the yoke 16. Attached to the top end of the pitch link member 20 is a rigid pitch shaft 22 which extends outward from the pitch link member 20 and is attached to the toy flying device housing 24. Rotatably secured within the toy flying device housing 24 is a rotor shaft 26 which is connected to rotor 28. The rotor shaft 26 is connected to a drive shaft 30 which is connected to the motor 14 at the other end. The length of the drive shaft 30 located between the motor 14 and the yoke 16 is contained within a drive shaft tube 32. Attached to the drive shaft 30 at the end of the drive shaft tube 32 in the yoke 16 is a swivel 34. Secured within the bottom cavity end 56 of the pitch link member 20 and around the drive shaft 30 is a drive shaft collar 36 which is crimped or swaged onto the drive shaft 30 permitting rotational movement, but translating longitudinal movement to the pitch link member 20. The toy flying system also includes a pitch shaft member 38. In the embodiment shown in FIG. 1, the toy flying system 10 utilizes a base molding 40 which may include a pivot member 42 and a control console 44. The control console 44 may also include a cavity 44*a* for receiving a pitch control member 46 and a slot 44*b* for receiving a power control member 48. Batteries (not shown) may also be located in control console 44.

The drive shaft 30 is a flexible cable which is capable of rotational motion and transferring linear motion. In preferred embodiments, the drive shaft 30 is a stranded cable made from stainless steel or filament-wound cable. However, it is contemplated that the drive shaft 30 may be constructed from other materials which are capable of rotational motion and transferring linear motion and still be within the scope of the invention.

Figure 2:
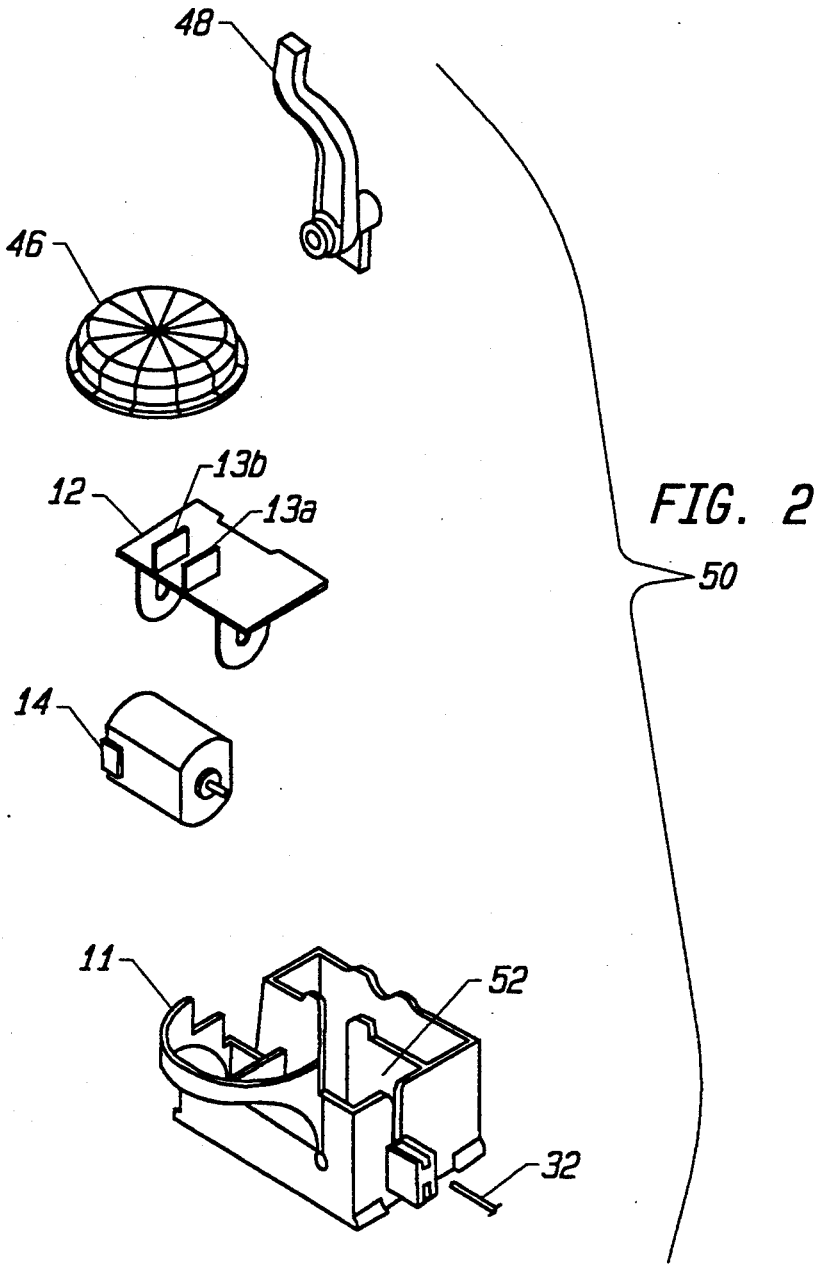
FIG. 2 is an exploded view of the motor housing and control members.

The pitch and speed of the toy flying device are controlled by the user interface components 50 shown in the exploded view of FIG. 2. The motor frame housing 11 has a motor frame member 52 for receiving the motor frame 12 and motor 14. The motor 14 may be a 3 volt, 1 watt Mabuchi motor, model FA260RA 2295. However, other d.c. motors of different voltage of power outputs can be used and still are intended to be within the scope of the present invention.

The motor frame 12 is mounted in the housing 11 such that it can freely slide longitudinally within the motor frame cavity 52. Attached to the motor frame housing 11 is the drive shaft tube 32 with the drive shaft 30 (not shown in FIG. 2) rotatably and slidably mounted inside. The motor frame 12 has two vertical ribs 13 on its upper surface to engage with a cylindrical boss (not shown) on the bottom surface of the pitch control 46 rotatably secured within the pitch control cavity 44*a* as shown in FIG. 1. The cylindrical boss has an axis that is parallel to the axis of the pitch control 46 but is mounted eccentrically. It engages or locates between the two vertical ribs 13 on the top surface of the motor frame 12. The motion of the motor frame 12 in the motor frame cavity 52 is limited to linear translation, backwards or forwards, coaxial with the drive shaft 30 by support bearings (not shown) molded in the motor frame cavity 52 and control console 44 of the base molding 40. Angular rotation of the pitch control 46 and the attached cylindrical boss causes a tangential component of linear displacement of the motor frame 12 because the cylindrical boss is secured between the two ribs 13 formed on the motor frame 12. Full forward to full aft pitch of the toy flying device is accomplished in approximately 90 degrees of pitch control 46 rotation. Other ribs (not shown) on the underside of the pitch control 46 impinge on surfaces molded onto the motor frame housing 11 to limit rotation of the pitch control 46 to approximately 90 degrees.

In a preferred embodiment, the pitch control 46 is a circular knob which can be rotated in the pitch control cavity 44*a* by the player. However, other rotatable devices, including joysticks, can be used and still are intended to be within the scope of the present invention. Further, in a preferred embodiment the user interface components 50 shown in FIG. 2 are contained in control console 44 in the base molding 40 shown in FIG. 1.

The drive shaft 30 (not shown) located within drive shaft tube 32, is connected to the motor 14 by drive shaft connector 15 as shown in FIG. 1. The drive shaft connector 15 is a cylindrical collar and is attached to the drive shaft 30 by crimping or other means generally known to those skilled in the art for securing a cylindrical collar around a cable. In a preferred embodiment, the drive shaft connector may also comprise two cylindrical portions separated by a circumferential groove and has a hole through the center for receiving the drive shaft 30. The drive shaft connector 15 is attached to the drive shaft 30 by twisting the two cylindrical portions of the drive shaft connector 15 in opposite directions while at the same time pushing the two cylindrical portions together. This causes the grooved portion to collapse onto the drive shaft 30 thereby securing the drive shaft connector 15 to the drive shaft 30. The drive connector 15 is connected to the motor 14 by a press fit or other means known to those skilled in the art.

Thus in operation, when the pitch control 46 is rotated clockwise by the player, the motor frame 12 and motor 14 are displaced longitudinally towards the yoke 16 causing the drive shaft 30 (not shown) to move longitudinally within the drive shaft tube 32. Similarly, when the pitch control 46 is rotated counterclockwise by the player, the motor frame 12 and motor 14 are displaced longitudinally away from the yoke 16 causing the drive shaft 30 to move within the drive shaft tube 32.

The speed of rotor 28 is controlled by power control 48 shown in FIGS. 1 and 2. In this embodiment, the player moves the power control 48 forward to increase the speed of the rotor 28 and backward to decrease the speed. In a preferred embodiment, the power control 48 is a joystick. However, it is contemplated that other levers can be used and are intended to be within the scope of the present invention.

Figure 3:
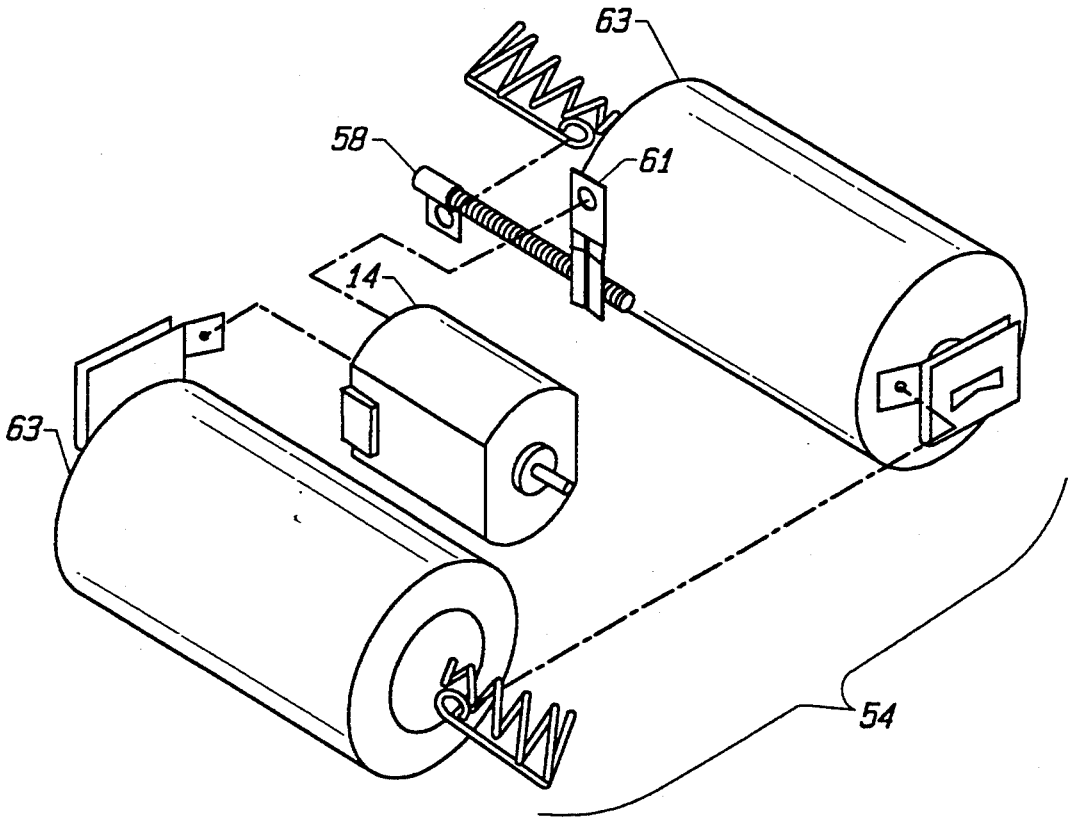
FIG. 3 is a perspective view of the batteries and motor supply circuit of the present invention.

Referring to FIG. 3, the power control 48 is attached (not shown) to the aperture on wiper contact 61. Therefore, movement of the power control 48 causes a similar motion to the wiper contact 61 since they are attached. The wiper contact 61 is also electrically connected to one of the terminals of the motor 14. As the power control 48 is moved by the player, the contact point between the wiper contact 61 and the rheostat 58 changes, thus modifying the electrical resistance in the motor supply circuit 54. At the full speed position of power control 48, the wiper contact 61 is at the extreme left end of the rheostat 58. Resistance at this position is zero, consequently the motor 14 sees the full voltage of the batteries 63 and the rotor 28 runs at maximum speed. At the other extreme, when the wiper contact 61 is at the extreme right end of the rheostat, approximately 4 ohms of resistance exists in the motor supply circuit 54 and the motor 14 receives just sufficient voltage to turn the rotor 28 slowly. Further motion of the power control 48 disconnects the wiper contact 61 from the rheostat 58 causing the power source to be disconnected. Thus, speed and altitude control of the toy flying device is controlled by varying the voltage applied to motor 14 from the batteries 63. In a preferred embodiment, wiper contact 61 is constructed from brass but may be constructed from any suitable conductive material generally known to those skilled in the art. Further, rheostat 58 may be constructed from nichrome, brass and glass or other suitable materials generally known to those skilled in the art.

Figure 4:
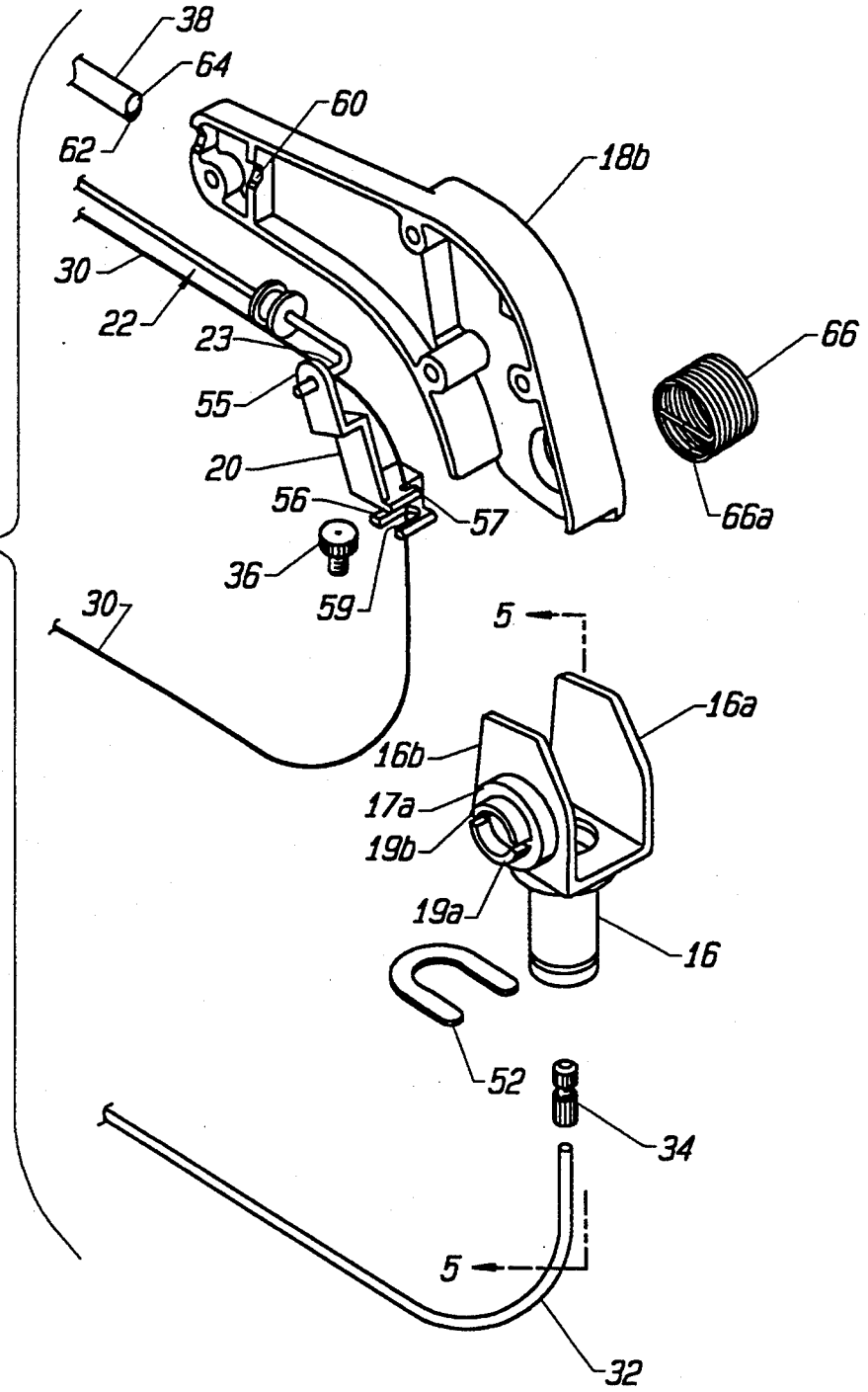
FIG. 4 is an exploded view of the pitch link member housing and yoke in accordance with one embodiment of the invention.

Referring now to FIG. 4, the pitch control system of the toy flying device includes a yoke 16 which is free to rotate within the pivot member 42 shown in FIG. 1. In a preferred embodiment, the pivot member 42 is a pylon. However, it is intended that the pivot member 42 be any type of tower which will allow the yoke 16 to freely rotate within it. The type of tower used may depend upon the theme of the playset selected for the base of the toy flying system and may include buildings, bridges and lookout towers. While the preferred embodiment of the present invention has been described with reference to a raised tower, it should be apparent to those of ordinary skill in the art that all that is required is a cavity to pivotally receive the yoke 16.

Figure 5:
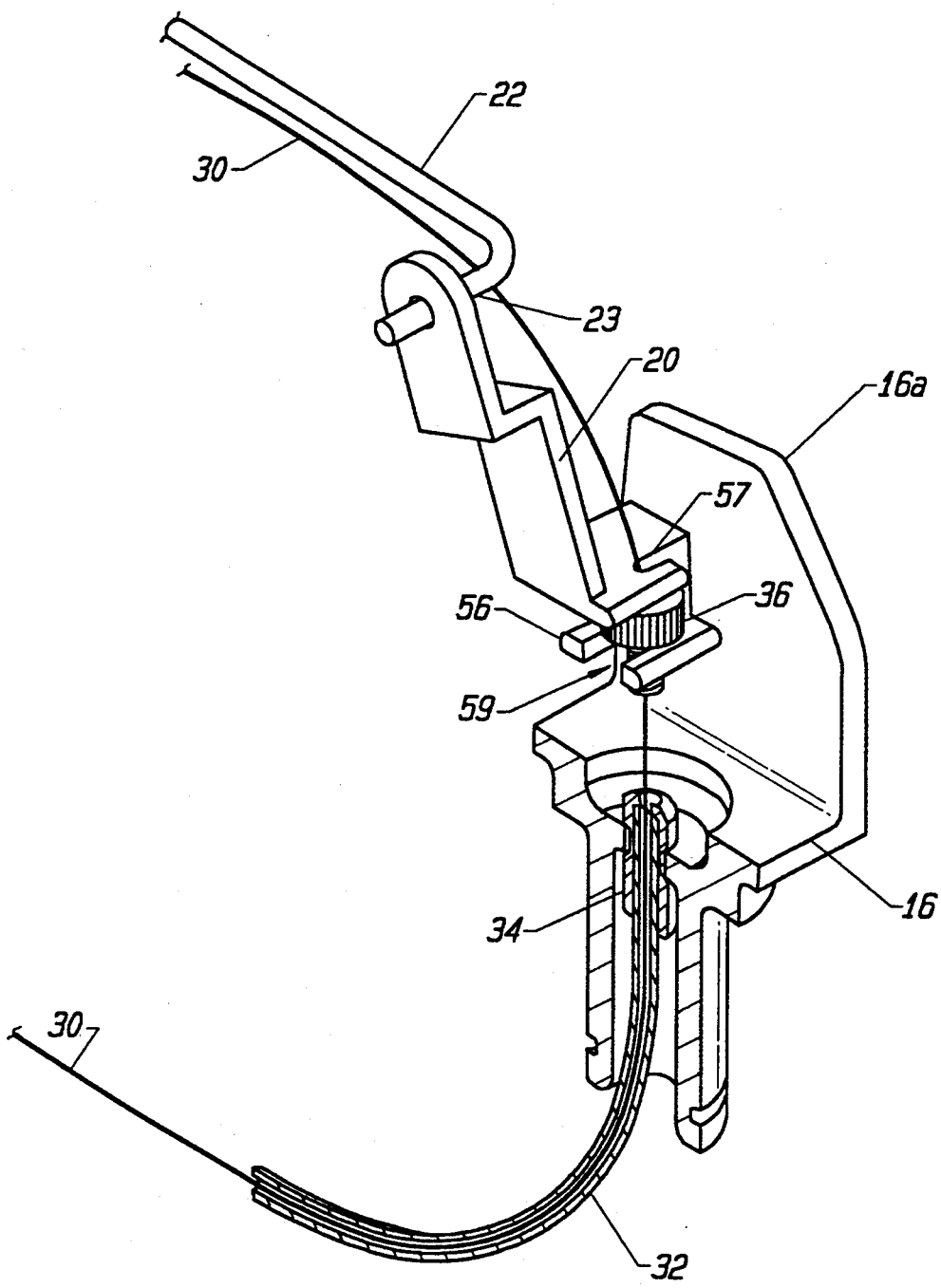
FIG. 5 is a perspective view taken along the line 5—5 of FIG. 4 showing the yoke partially cut-away with the pitch link member extended.

As shown in FIGS. 4 and 5, yoke 16 has wings **16*a* and 16*b* at its top end and an aperture in the body of the yoke 16 for receiving the end of the drive shaft tube 32. The end of the drive shaft tube 32 is secured in the aperture in the body of the yoke 16 by a swivel 34 which is snap fit in the aperture. However, in a presently preferred embodiment of the present invention, swivel 34 is not necessary to secure the drive shaft tube 32 in the aperture of the yoke 16. The end of the drive shaft tube 32 can be secured within the yoke 16 by the drive shaft 30 which runs through the drive shaft tube 32 and the aperture of the yoke 16. The yoke 16 is secured within the pivot member 42 by a yoke retainer 52 which allows the yoke 16 to freely rotate within the pivot member 42. The yoke 16 is rotatably secured to the pitch link member housing 18*a* and 18*b* (only link member housing 18*b* shown in FIG. 4) by connecting the cylinders 17 (only 17*a* shown in FIG. 4) located on the outer surfaces of the yoke wings 16*a* and 16*b* with the inner surfaces of the pitch link member housing 18. These connecting cylinders 17 permit the pitch link member housing 18 to rotate clockwise and counterclockwise in a vertical plane about the yoke cylinders 17** as the toy flying device moves vertically up and down during flight. It is contemplated by the present invention that the toy flying device have at least ten inches of vertical flight measured (from the table top or floor to the bottom of the toy flying device at its highest point).

Pitch link member 20 is located in the space formed between the yoke wings **16*a* and 16*b*. The pitch link member 20 has a cavity 56 at its bottom end for receiving the drive shaft collar 36. At the bottom of the cavity 56 has a U-shaped slot 59 which rotatably secures the bottom of the drive shaft collar 36. The pitch link member 20 also has a slot 57 so that the drive shaft 30 may pass through the drive shaft collar 36 when in it is secured in the cavity 56. The slot 57 also prevents the drive shaft collar 36 from sliding out of the cavity 56 during operation of the toy because of the opposing tensions on the drive shaft 30 created by U-shaped slot 59 and slot 57. At its top end 58, the pitch link member 20 has an aperture for connecting to the pitch shaft arm 23. While the pitch link member 20 has been described with reference to a preferred embodiment, other shapes and designs can be used to translate the upward movement of the drive shaft 30 and drive shaft collar 36 to the pitch shaft 22**. The selection of these shapes and designs are within the skill of the ordinary artisan.

When secured in the cavity 56, the drive shaft collar 36 is free to rotate. The purpose of the drive shaft collar 36 is to translate linear motion of the drive shaft 30 to the pitch link member 20 without restraining the rotation of the drive shaft 30. Thus, the drive shaft collar 36 is crimped or swaged to the drive shaft 30 so that it rotates in the cavity 56 coincidentally with the rotation of the drive shaft 30. In a preferred embodiment, the drive shaft collar 36 comprises two cylindrical portions of different diameters separated by a circumferential groove. The top cylindrical portion of the drive shaft collar 36 has a larger diameter than the bottom cylindrical portion so that it can be rotatably secured in the cavity 56. The drive shaft collar 36 has a hole through the center for receiving the drive shaft 30. The drive shaft collar 36 is attached to the drive shaft 30 by twisting the top and bottom cylinders of the drive shaft collar 36 in opposite directions while at the same time pushing the top and bottom cylinders together. This causes the grooved portion to collapse onto the drive shaft 30 thereby securing the drive shaft collar 36 to the drive shaft 30. In a preferred embodiment, the drive shaft collar 36 is constructed from brass. However, it is contemplated that the selection of other suitable rigid materials formed into different shapes is within the skill of the ordinary artisan and are intended to be within the scope of the present invention.

A more detailed illustration of the interconnections of the pitch control system of the present invention is shown in FIG. 5. Attached to the end of the drive shaft tube 32 is a swivel 34 which is press fit onto the drive shaft tube 32 end. The swivel 34 is snap fit within the yoke 16, free to rotate within the yoke 16. The swivel 34 secures the end of the drive shaft tube 32 within the yoke 16. Since the other end of the drive shaft tube 32 is secured to the motor housing 11, the relative motion of the drive shaft 30 through the drive shaft tube 32 introduced at the drive motor 14 appears at the opposite of the drive shaft tube 32 at the swivel 34 end. In presently preferred embodiment, the swivel 34 is eliminated and the end of the drive shaft tube 32 is secured within the yoke 16 by the drive shaft 30 which runs through it. The motion of the drive shaft 30 is translated to upward displacement of the pitch link member 20 through the drive shaft collar 36. Since the pitch shaft 22 is connected to the top end 55 of the pitch link member 20, this upward displacement of the pitch link member 20 causes rotation of the pitch shaft 22 as is described in more detail below.

Referring now to FIG. 4 which shows a preferred embodiment, at the top end of the pitch link member housing 18, pitch shaft control member 38 is secured between the the pitch link member housing 18*a* and 18*b* by indent 60 which prevents the pitch shaft control member 38 from moving. The pitch shaft control member 38 extends outward from the pitch link member housing 18 towards the toy flying device housing but it is not connected to the housing. Pitch shaft 22 is rotatably secured within a pitch shaft channel 64 within the pitch shaft control member 38. This allows the pitch shaft 22 to freely rotate within the pitch shaft control member 38 without moving. The pitch shaft control member 38 also has a drive shaft channel 62 for rotatably securing the drive shaft 30 within the pitch shaft control member 38. The purpose of the pitch shaft control member 38 is to provide support for the drive shaft 30 and pitch shaft 22. The pitch shaft control member 38 also keeps the drive shaft 30 in close proximity to the pitch shaft 22 while still allowing both the drive shaft 30 and pitch shaft 22 to rotate freely. This prevents the drive shaft 30 from becoming tangled up with the pitch shaft 22 during operation.

While the preferred embodiment of the pitch shaft control member 38 has been described with reference to a single tube having two channels, it is contemplated that the pitch shaft control member 38 can have one channel running through it for rotatably receiving the drive shaft 30. It is also contemplated that multiple lengths of tubing coaxially disposed along the drive shaft 30 can be used in lieu of a single tube as well as other techniques for accomplishing the indended purposes of the pitch shaft control member 38 which are within the skill of the ordinary artisan.

For example, in another embodiment the pitch shaft 22 is secured between the pitch link member housing 18*a* and 18*b* by indent 60 without the use of a pitch shaft control member. Indent 60 located on the inside of both shells of the pitch link member housing 18 allows the pitch shaft 22 to freely rotate within the pitch link member housing 18 but not to move in any direction. Multiple lengths of tubing, or other means within the skill of the ordinary artisan are then used along the length of the pitch shaft 22 to rotatably secure both the pitch shaft 22 and drive shaft 30 in close proximity to each other.

Rotation of the pitch shaft 22 is caused by upward displacement of the pitch link member 20. In a preferred embodiment, the pitch shaft 22 has an arm 23 extending radially outward at the end secured within the pitch link member housing 18. This arm 23 of the pitch shaft 22 is connected to the aperture at the top end 55. When the pitch link member 20 moves upwardly, it causes the arm 23 of the pitch shaft 22 to also move upwardly. This in turn causes rotation of the pitch shaft 22. Movement of the pitch link member 20 is caused by the drive shaft collar 36 secured in the cavity 56. The drive shaft collar 36 is crimped or swaged to the drive shaft 30 so the drive shaft collar 36 rotates coincidentally with the drive shaft 30. Longitudinal movement of the drive shaft 30 through the drive shaft tube 32 is translated to the pitch link member 20 by the drive shaft collar 36 secured in the cavity 56. The longitudinal movement of the drive shaft 30 results from rotation of the pitch control 48 as shown in FIG. 2. The pitch control 48 causes the motor frame 12 to slide longitudinally in the motor frame cavity 52 in the motor housing 11. This movement of the motor frame 12 causes the drive shaft 30 to move longitudinally within the drive shaft tube 32 which is attached to the motor housing 11. While the pitch shaft 22 has been described with reference to a shaft with two radially extending arms, it is contemplated that other means are available to connect the pitch shaft 22 to the pitch link member top end 55 and the toy flying device housing 24.

Figure 6:
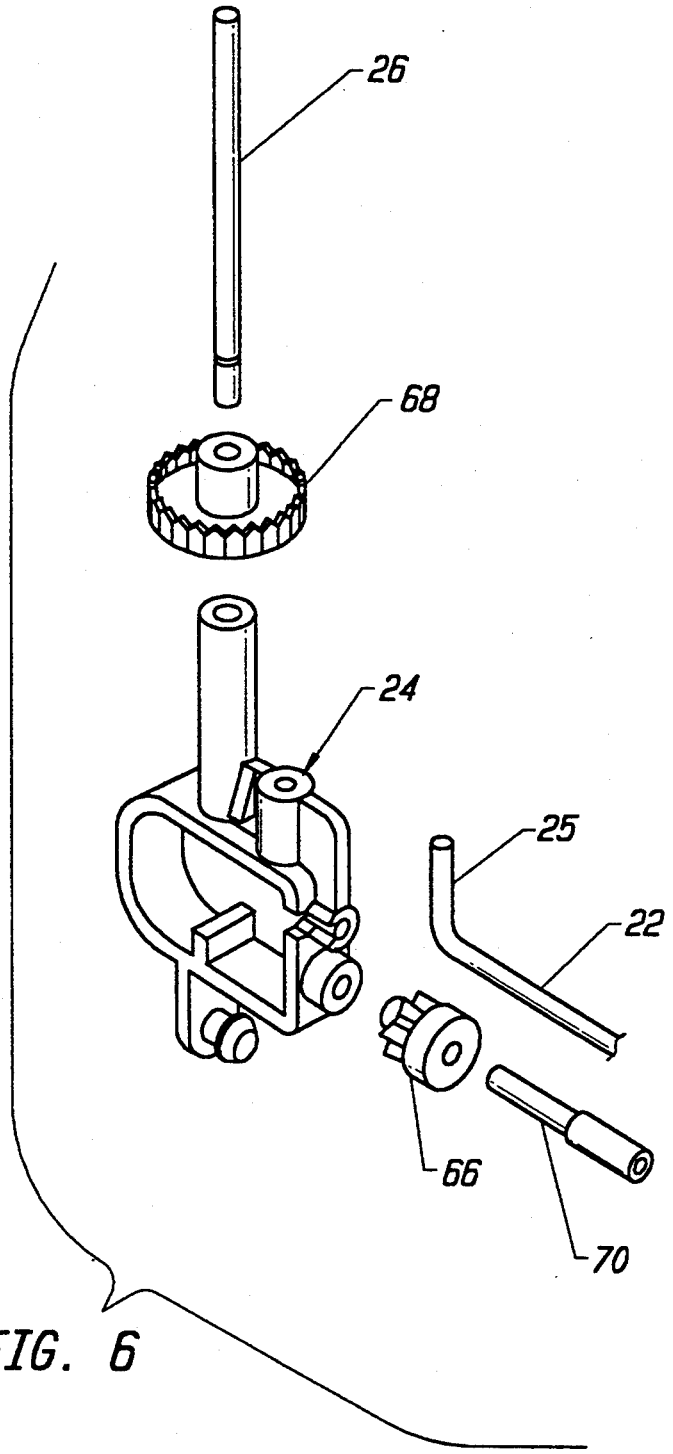
FIG. 6 is an exploded view of the flying device housing in accordance with one embodiment of the invention.

Referring now to the preferred embodiment shown in FIG. 6, at the other end of the pitch shaft 22, arm 25 extends radially outward from the pitch shaft 22. This arm 25 is positioned so that it extends radially outward from the pitch shaft 22 ninety degrees (90°) out of phase from arm 23 of the pitch shaft 22. Arm 25 is connected to the toy flying device housing 24 such that rotation of the pitch shaft 22 translates to a corresponding rotation of the toy flying device housing. Rotation of the toy flying device housing 24 causes a corresponding change in the pitch of the toy flying device. It is not necessary for arm 25 to be positioned ninety degrees (90°) out of phase from arm 23. Any angle between 0° and 90° will suffice. In fact, the arm 25 is not necessary to connect pitch shaft 22 to the toy flying device housing. Pitch shaft 22 can be connected directly to the toy flying device housing by means known to those skilled in the art.

The drive shaft 30 (not shown) is connected to the pinion shaft 70 in the same manner as described above for connecting the drive connector 15 and the drive shaft collar 36 to the drive shaft 30. Pinion shaft 70 is connected to the pinion gear 66 by a press fit or other means known to those skilled in the art. Pinion gear 66 is connected to crown gear 68 which is connected to the rotor shaft 26. Connecting the drive shaft 30 to the rotor shaft 26 by pinion gear 66 and crown gear 68 causes the rotation of the drive shaft 30 to bend through ninety degrees up to the rotor shaft 26. However, it is within the skill of the ordinary artisan to implement other means to accomplish bending the drive shaft 30 through ninety degrees. Such means may include a drive shaft spring as described in U.S. Pat. No. 3,740,032 or well-known universal joints.

The toy flying device may also include a hook that hangs under the toy flying device in flight to hook onto, lift and transport objects from one area of the play set to another around its fixed radius of flight. Referring back to FIG. 4, in order to minimize the power required to create lift through the rotor 28, an arm spring 66 may be provided in the pitch link member housing 18 to counterbalance the weight of the flying device. This would counter the weight or force on the toy flying device caused by whatever is attached to the pitch shaft 22, including the toy flying device itself. The ends 66*a* (only one shown) of the arm spring 66 on either side are bent back across the inside diameter of the arm spring 66. The arm spring 66 is secured around cylindrical boss 19 located on the outside of yoke wing 16*a* such that the end 66*a* is held within the slot between the top half 19*a* and bottom half 19*b* of the cylindrical boss. The arm spring 66 is also secured in the same manner to a cylindrical boss (not shown) on the inside surface of the pitch link member housing 18*a* shown in FIG. 1. The arm spring 66 is secured on the yoke wing 16*a* and in the pitch link member housing 18 in a prerotated position. This position is attained by rotating the ends 66*a* in opposite directions. In another embodiment, to counterbalance the weight at the end of the pitch shaft 22, a weight may be added past the pivot point of the pitch shaft 22 opposite the toy flying device.

Now referring to FIG. 1, in operation when the pitch control 48 is rotated clockwise past its center or neutral position, the motor frame 12, the motor 14 and the drive shaft 30 are displaced longitudinally to the right. The drive shaft 30, which is mounted within the drive shaft tube 32 moves upward through the yoke 16 and causes the drive shaft collar 36 to lift the pitch link member 20 upward. The pitch link member 20 in turn causes the pitch shaft 22 to rotate within the pitch shaft control member 38 which is secured in the indent 60 in the pitch link member housing 18 at one end and extends outward towards the toy flying device housing 24 at the other end. Rotation of the pitch shaft 22 is then transferred to the toy flying device which will experience a corresponding change in pitch of the toy flying device rotor 28. This change in pitch of the rotor 28 results in a horizontal component of lift causing the toy flying device to travel clockwise around the pivot member 42. Rotation of the pitch control 48 in the counterclockwise direction past the center or neutral position causes a similar effect on the pitch control system of the present invention except that the toy flying device will travel in the counterclockwise direction around the pivot member.

One of the primary advantages of the pitch control system of the present invention is that the pitch of the toy flying device is controlled using the same drive shaft and drive shaft tube as that used to transmit power to the rotor of the toy flying device. Another advantage of the pitch control system of the present invention is that it eliminates the friction generated during pitch control of the rotor. This results in better sensitivity of the pitch control 46 and thus better control of the pitch of the toy flying device.

Referring now to FIG. 2, in another embodiment of the present invention, the drive shaft tube 32 is connected directly to the motor frame 12 rather than the motor frame housing 11. Motor 14 is secured within motor frame cavity 52 so that it cannot move longitudinally. The other end of the drive shaft tube 32 is connected directly to the pitch link member cavity 56 on the bottom end of the pitch link member 20 rather than being secured within the yoke 16 by the drive shaft 30 or swivel 34. Further, since the drive shaft tube 32 is connected directly to the pitch link member 20, the drive shaft collar member 36 is not required to move the pitch link member 20 upwardly and downwardly in the space between the yoke wings 16. Upward displacement of the pitch link member 20 is effectuated by the corresponding movement of the drive shaft tube 32 which is caused by rotation of the pitch control 46. With the drive shaft tube 32 being secured to the motor frame 12, since the motor 14 is secured within the motor housing 11 and the drive shaft 30 is connected to the motor 14, the drive shaft tube 32 moves longitudinally towards the yoke 16, relative to the drive shaft 30, when the pitch control 46 is rotated by the player. However, the drive shaft 30 is still free to rotate inside the drive shaft tube 32. In this embodiment, the relative motion between the drive shaft 30 and the drive shaft tube 32 are reversed from the previously described embodiment.

Another option for this embodiment involves a drive shaft tube 32 with the drive shaft 30 running through it and an additional stationary extruded tube which is connected to the motor housing 11 at one end and secured within the yoke 16 at the other end by a snap fit swivel or otherwise as described above for FIG. 5. In this configuration, the drive shaft tube 32 would still be able to move longitudinally through this extruded tube and the drive shaft 30 would still be able to rotate within the drive shaft tube 32 which is secured inside the extruded tube.

While the invention has been described herein with respect to certain embodiments, there are other embodiments and features which are intended to be within the scope of the invention without departing from the spirit of the invention.

We claim:

1. A toy flying system comprising:

I. a flying device having:
   1. a housing;
   2. a rotor; and
   3. a rotor shaft;

II. a base having:
   1. a pivot member;
   2. a motor housing;
   3. a motor having a longitudinal axis;
   4. a motor frame for receiving the motor, the motor frame being slidably received within the motor housing; and
   5. a pitch control member connected to the motor frame and a power control member electrically connected to the motor;

III. a pitch control system having:
   1. a pitch link member housing;
   2. a yoke having a top end rotatably secured to the pitch link member housing and a bottom end rotatably received within the pivot member;
   3. a pitch link member received within the yoke, having a bottom cavity end and a top end;
   4. a rigid elongated pitch shaft having proximal and distal ends and further having means at the proximal end for connecting the pitch shaft to the pitch link member top end so that the pitch shaft is allowed to rotate about its longitudinal axis and further having means at the distal end for connecting the pitch shaft to the flying device housing;
   5. a drive shaft tube having a proximal end rigidly connected to the motor frame and a distal end securedly attached to the pitch link member bottom cavity end;
   6. a drive shaft having a proximal end rigidly connected to the motor and a distal end rigidly attached to the flying device rotor shaft wherein the drive shaft is rotatably and slidably received within the drive shaft tube; and 7. a pitch shaft control member having a first channel for rotatably receiving the drive shaft;

wherein the power control member controls the flying device rotor speed and the pitch control member controls the flying device rotor pitch.

2. The toy flying system of claim 1 further comprising an extruded tube having a proximal end rigidly connected to the motor housing and a distal end rigidly connected to the pivot member wherein the drive shaft and the drive shaft tube are slidably received within the extruded tube.

3. The toy flying system of claim 1 wherein the power control member is a joystick for controlling the flying device rotor speed.

4. The toy flying system of claim 1 wherein the pitch control member is a rotatable knob for controlling the flying device rotor pitch.

5. The toy flying system of claim 1 wherein the drive shaft is a stranded cable.

6. The toy flying system of claim 1 wherein the pivot member is a pylon.

7. The toy flying system of claim 1 wherein the flying device is selected from the group consisting of a helicopter, an airplane and a spaceship.

8. The toy flying system of claim 1 wherein the base comprises a military playset.

9. The toy flying system of claim 1 wherein the base comprises a construction playset.

10. The toy flying system of claim 1 wherein the pitch shaft proximal end connecting means comprises an arm extending radially outward from the pitch shaft proximal end and an aperture in the pitch link member top end.

11. The toy flying system of claim 1 wherein pitch shaft distal end connecting means comprises an arm extending radially outward from the pitch shaft distal end and rigidly attached to the flying device housing.

12. The toy flying system of claim 1 wherein the pitch shaft control member further comprises a second channel for rotatably receiving the pitch shaft.

13. A toy flying system comprising:

I. a flying device having:

1. a housing;
2. a rotor; and
3. a rotor shaft;

II. a base having:

1. a pivot member;
2. a motor housing;
3. a motor having a longitudinal axis;
4. a motor frame for receiving the motor, the motor frame slidably received within the motor housing for displacing the motor along its longitudinal axis; and
5. a control unit having a pitch control member connected to the motor frame member and a power control member electrically connected to the motor;

III. a pitch control system having:

1. a pitch link member housing;
2. a yoke having a top end rotatably secured to the link member housing and a bottom end rotatably received within the pivot member;
3. a pitch link member received within the yoke, having a bottom cavity end and a top end;
4. a drive shaft collar rotatably secured to the pitch link member bottom cavity end;
5. a rigid elongated pitch shaft having proximal and distal ends and further having means at the proximal end for connecting the pitch shaft to the pitch link member top end so that the pitch shaft is allowed to rotate about its longitudinal axis and further having means at the distal end for connecting the pitch shaft to the flying device housing;
6. a drive shaft tube having a proximal end rigidly connected to the motor housing and a distal end secured within the yoke;
7. a drive shaft having a proximal end rigidly connected to the motor and a distal end rigidly attached to the flying device rotor shaft wherein the drive shaft is rotatably and slidably received within the drive shaft tube, the drive shaft being secured to the drive shaft collar such that rotation of the drive shaft causes rotation of the drive shaft collar;
8. a pitch shaft control member having a first channel for rotatably receiving the drive shaft;

wherein the power control member controls the flying device rotor speed and the pitch control member controls the flying device rotor pitch.

14. The toy flying system of claim 13 wherein the pitch shaft proximal end connecting means comprises an arm extending radially outward from the pitch shaft proximal end and an aperture in the pitch link member top end.

15. The toy flying system of claim 13 wherein pitch shaft distal end connecting means comprises an arm extending radially outward from the pitch shaft distal end arid rigidly attached to the flying device housing.

16. The toy flying system of claim 13 wherein the pitch shaft control member further comprises a second channel for rotatably receiving the pitch shaft.

17. The toy flying system of claim 13 wherein the power control member is a joystick for controlling the flying device rotor speed.

18. The toy flying system of claim 13 wherein the pitch control member is a rotatable knob for controlling the flying device rotor pitch.

19. The toy flying system of claim 13 wherein the drive shaft is a stranded cable.

20. The toy flying system of claim 13 wherein the pivot member is a pylon.

21. The toy flying system of claim 13 wherein the flying device is selected from the group consisting of a helicopter, an airplane and a spaceship.

22. The toy flying system of claim 13 wherein the base comprises a military playset.

23. The toy flying system of claim 13 wherein the base comprises a construction playset.

24. The toy flying system of claim 13 further comprising a swivel rotatably received within the yoke for securing the drive shaft tube within the yoke.

* * * * *